United States Patent [19]

Sakurahara et al.

[11] Patent Number: 4,846,116

[45] Date of Patent: Jul. 11, 1989

[54] CYLINDER BLOCK FOR INTERNAL COMBUSTION ENGINE

[75] Inventors: Kazuo Sakurahara; Junji Kinugasa; Tsuyoshi Kawabe, all of Saitama, Japan

[73] Assignee: Honda Giken Kogyo Kabushiki Kaisha, Tokyo, Japan

[21] Appl. No.: 149,669

[22] Filed: Jan. 28, 1988

[30] Foreign Application Priority Data

Feb. 4, 1987 [JP] Japan ..... 62-24301

[51] Int. Cl.[4] ..... F01P 3/02

[52] U.S. Cl. ..... 123/41.74; 123/41.82 R

[58] Field of Search ..... 123/41.72, 41.74, 41.79, 123/41.82 R, 195 H

[56] References Cited

U.S. PATENT DOCUMENTS

| | | | |
|---|---|---|---|
| 1,410,847 | 3/1922 | Still | 123/41.79 X |
| 2,635,592 | 4/1953 | Hollis | 123/41.72 X |
| 2,681,054 | 6/1954 | Boghossian | 123/41.74 X |
| 3,744,462 | 7/1973 | Herschmann et al. | 123/41.72 X |
| 3,939,807 | 2/1976 | Eichinger | 123/41.72 X |
| 4,365,593 | 12/1982 | Pomfret | 123/41.79 X |
| 4,394,850 | 7/1983 | Hayashi | 123/41.74 |
| 4,515,112 | 5/1985 | Tsuchiya et al. | 123/41.84 |
| 4,616,600 | 10/1986 | Hirano | 123/41.74 |
| 4,686,943 | 8/1987 | Anno et al. | 123/41.74 |

FOREIGN PATENT DOCUMENTS

| | | | |
|---|---|---|---|
| 294411 | 10/1916 | Fed. Rep. of Germany | 123/41.79 |
| 5743338 | 8/1955 | Japan . | |
| 57-149613 | 9/1982 | Japan . | |

*Primary Examiner*—Noah P. Kamen

*Attorney, Agent, or Firm*—Nixon & Vanderhye

[57] ABSTRACT

A water-cooled multi-cylinder internal combustion engine comprises a water jacket which extends deeper towards the crank case than conventional water jackets without increasing the width of the water jacket. As a result, the lubricating oil in the crank case is effectively cooled by the cooling water. Further, the narrower and deeper water jacket improves the overall cooling efficiency of the cylinder block and the reduced volume of the water jacket speeds up the warm-up of the engine. Casting of this cylinder block is made possible by providing projections at the bottom ends of the water jacket intermediate between adjacent cylinders. These projections facilitates the process of pulling out the core for defining the water jacket during the casting process from the water jacket of the cylinder block without causing any undue stress either to the core or to the cylinder block.

15 Claims, 2 Drawing Sheets

CYLINDER BLOCK FOR INTERNAL COMBUSTION ENGINE

TECHNICAL FIELD

The present invention relates to a cylinder block for a water-cooled internal combustion engine and in particular to such a cylinder block which has an improved cooling efficiency.

BACKGROUND OF THE INVENTION

In recent years, as the output levels of internal combustion engines become higher, excessive rise in the temperature of the lubricating oil has come to be a major problem. To achieve a better cooling of the lubricating oil, an oil cooler is used in some cases. However, the use of an oil cooler means an increase in the manufacturing cost due to the increase in the number of component parts and the increased complexity of the manufacturing process. Furthermore, it leads to the increase in the weight of the engine which is not desirable when it is used as an automotive engine.

Additionally, particularly when die cast aluminum alloy is used as the material for the cylinder block, it is desired to achieve uniform cooling of the cylinder block to the end of preventing undue or local thermal expansions of various parts of the cylinder block. Excessive or local thermal expansion of a cylinder block causes an increase in the clearance between the cylinder bores and the pistons and this in turn could cause not only increased consumption of lubricating oil but also scuffing, seizing and so on.

Furthermore, to speed up the warm-up of the engine and the heater which makes use of the engine cooling water, it is desired to minimize the volume of the cooling water which circulates the engine cooling system.

These problems can be solved by providing a water jacket which extends substantially the whole length of the cylinders and reaches into the crank case while its width, the spacing between the outer surface of the cylinder block inner wall and inner surface of the outer wall of the cylinder block, is minimized. Thus, the lubricating oil in the crank case, as well as the wall of the cylinder bore in which combustion takes place, is effectively cooled without substantially increasing the volume of the water jacket. This is, however, extremely difficult to accomplish particularly when the cylinder block is made of die cast aluminum alloy since, during the casting process, the water jacket is defined by a core which forms a part of the casting die set and this core needs to be pulled out upon completion of the casting process. If the thickness of the core is small, it is difficult to assure a sufficient mechanical strength and rigidity to the core. Furthermore, as the core is pulled out against the frictional force it experiences from the mating surface of the water jacket, it could generate undue stress in the cast cylinder block and care must be taken to prevent generation of cracks in the part of the cylinder block which is adjacent to the water jacket.

U.S. Pat. No. 4,515,112 proposes an alternative approach to this problem. According to the invention of this U.S. Patent, a rib or ribs are provided in strategic places between the cylinder sleeve or the cylinder block inner wall and the cylinder block outer wall to connect them together for reinforcing the cylinder block inner wall defining cylinder bores to the end of eliminating uneven thermal deformation of the cylinder block inner wall. Japanese Utility Model Laid-Open Publication 57-43338 proposes the use of a filler member made of porous material in the water jacket in such a manner that the whole length of the cylinder may be evenly cooled. However, these approaches are not based on free circulation of cooling water and do not necessarily promote efficient cooling of the cylinder block.

BRIEF SUMMARY OF THE INVENTION

In view of such problems of the prior art, a primary object of the present invention is to provide a cylinder block for a water-cooled internal combustion engine having an improved capability to cool the lubricating oil in its crank case.

A second object of the present invention is to provide a cylinder block for a water-cooled internal combustion engine which is adapted to be cooled evenly by cooling water and is free from excessive or uneven thermal expansion.

A third object of the present invention is to provide a cylinder block for a water-cooled internal combustion engine having a high cooling performance which can be manufactured without undue production management problems.

A fourth object of the present invention is to provide a cylinder block for a water-cooled internal combustion engine in which the volume of the water jacket is minimized for faster warm-up of the engine and the cabin heater which uses the cooling water as its heat source.

These and other objects of the present invention can be accomplished by providing a cylinder block for a water-cooled multi-cylinder internal combustion engine, comprising a cylinder block inner wall defining an outer surface of a plurality of cylinders, a cylinder block outer wall defining a water jacket in cooperation with the cylinder block inner wall and a skirt extending from a part of the cylinder block outer wall where the latter is joined to the cylinder block inner wall to define a bottom end of the water jacket, a crank case being defined at least partly by the skirt, wherein: a part of the bottom end of the water jacket is provided with a projection which projects towards an open end of the water jacket. Preferably, a projection having a semi-cylindrical shape is provided at each part of the bottom end of the water jacket intermediate between adjacent cylinders.

At the part of the bottom end of the water jacket which is located between adjacent cylinders, the configuration of the contact surface between the core and the inner surface of the water jacket is relatively complex. Therefore, this region makes a significant contribution to the difficulty in releasing the core from the cylinder block. The provision of the projection in this region is therefore highly effective in reducing the force required to pull out the core. Furthermore, the core is provided with a depression corresponding to the projection to be formed at the bottom end of the water jacket and this depression reduces the susceptibility of the part of the core having a complex configuration to the notch effect. This permits the use of a longer core to thereby increase the depth of the water jacket around each cylinder without increasing the width of the water jacket and the bottom end of the water jacket can be brought closer to the crank case than was possible with conventional cylinder blocks.

According to another aspect of the present invention, the projection is provided in a part of the bottom end of the water jacket corresponding to a bearing bulkhead provided in the crank case. Thus, the provision of the projection does not cause any substantial impairment of the cooling efficiency of the cylinder block.

According to a further aspect of the present invention, the thickness of the cylinder block between the bottom end of the water jacket and the inner surface of the crank case with the exception of the part where the projection is provided is no greater than the width of the water jacket at its bottom end.

According to a yet further aspect of the present invention, the ratio of the depth of the water jacket to the width thereof is no less than 15 for a favorable cooling effect without unduly increasing the volume of the water jacket.

According to a yet further aspect of the present invention, the cylinder block is made by die casting.

BRIEF DESCRIPTION OF THE DRAWINGS

The present invention will now be shown and described in the following in terms of a concrete embodiment thereof with reference to the appended drawings, in which.

DETAILED DESCRIPTION OF THE PREFERRED EMBODIMENT

Now an embodiment of the present invention is described in the following with reference to the appended drawings.

Figure 1:
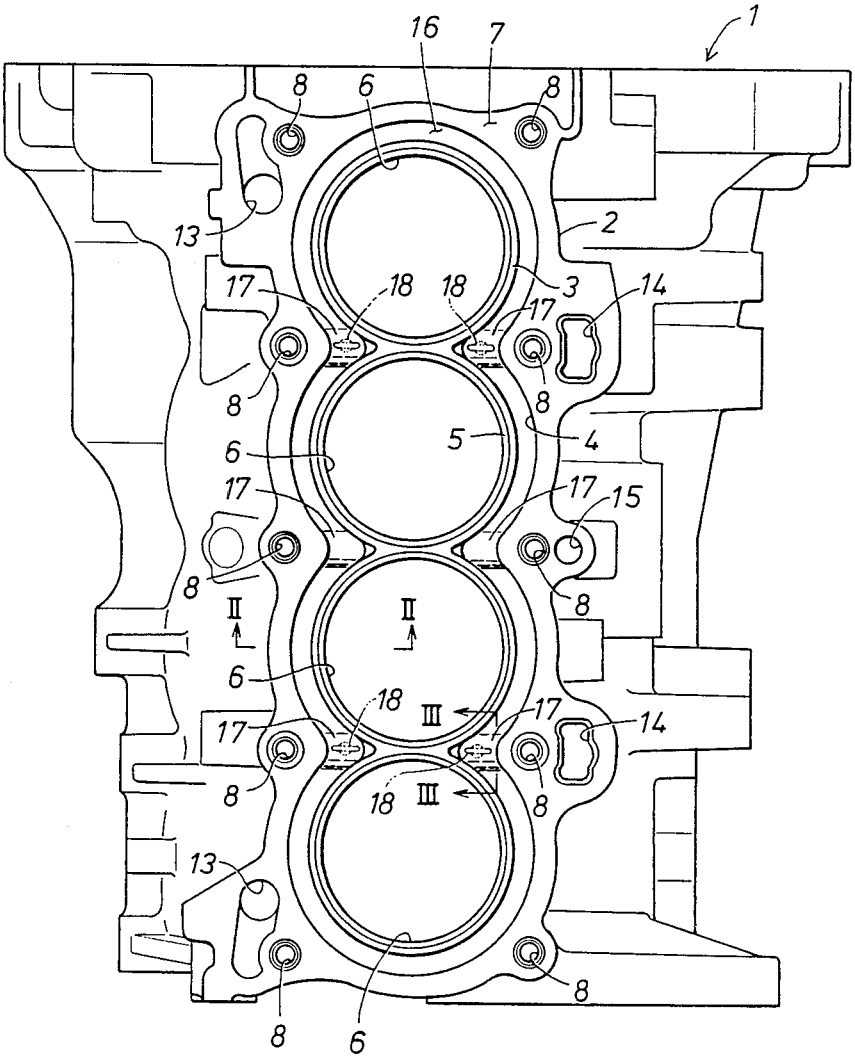
FIG. 1 is a plan view of an in-line four-cylinder internal combustion engine to which the present invention is applied.
Figure 3:
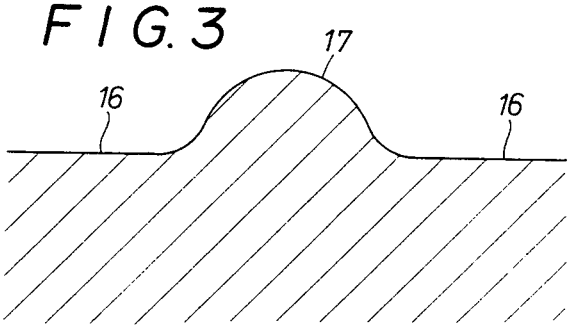
FIG. 3 is a sectional view taken along line III—III of FIG. 1.

FIG. 1 is a plan view of a cylinder block of an in-line four-cylinder water-cooled internal combustion engine and a water jacket 4 is defined between an outer wall 2 and an inner wall 3 of the cylinder block 1 which is made of, for instance, die-cast aluminum alloy. The cylinder block inner wall 3 is integrally cast with four cylinder sleeves 5 each of which defines a cylinder bore 6 for slidably fitting a piston not shown in the drawings therein. The cylinder block outer wall 3 defines an outer shell of the cylinder block 1. The inner diameter of the cylinder sleeve 5 is 75 mm in the present embodiment.

The upper surface 7 of the cylinder block 1 is finished flat by grinding for joining a cylinder head which is not shown in the drawings thereto. The upper end surface of the cylinder block outer wall 2 is provided with ten bolt holes 8, a pair of them being provided laterally in laterally spaced manner at each of the intermediate positions between adjacent cylinder bores and the outer most positions along the cylinder row. These bolt holes 8 are provided with threads for receiving threaded bolts therein for connecting the cylinder head to the upper surface 7 of the cylinder block 1.

Figure 2:
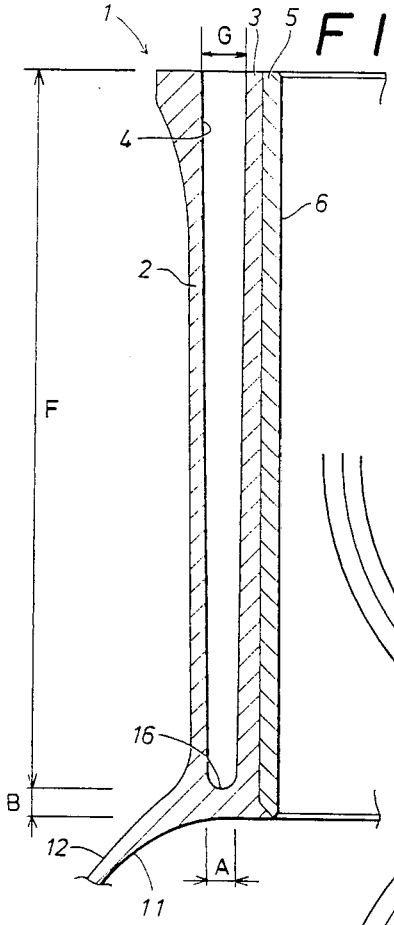
FIG. 2 is a local sectional view taken along line II—II of the water jacket shown in FIG. 1 to which the present invention is applied.
Figure 4:
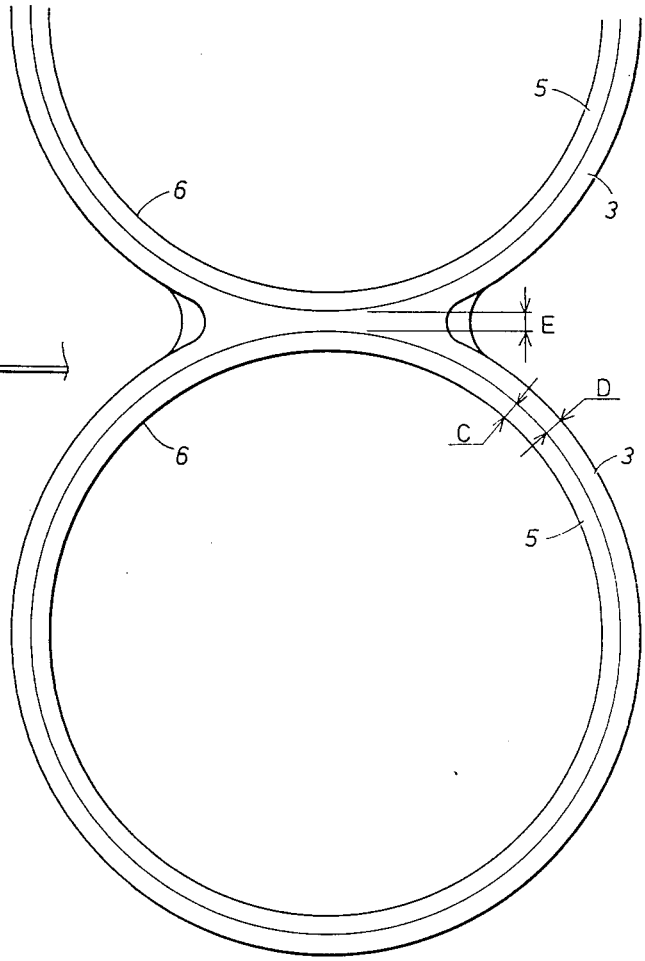
FIG. 4 is an enlarged plan view of one of the cylinders shown in FIG. 1.

FIG. 2 is a local sectional view taken along line II—II of FIG. 1 and shows a skirt 12 which extends from a bottom end 16 of the water jacket 4 where the lower ends of the cylinder block inner wall 3 and the cylinder block outer wall 2 meet each other. The skirt 12 extends from both sides of the cylinder block 1 and an oil pan not shown in the drawings is attached to the lower end of this skirt to define the crank case 11 of this engine.

An oil return passage 13 is formed at each longitudinal end of the cylinder block on the left hand side thereof as seen in FIG. 1 to return the lubricating oil which has lubricated an engine valve unit provided in the cylinder head back to the oil pan. A right hand part of the cylinder block 1 is provided with a pair of crank case ventilation passages 14 for conducting blow-by gas between the cylinder head and the crank case 11 adjacent to the second cylinder and the third cylinder as shown in FIG. 1. Further, a central part of the right hand side of the cylinder block 1 is provided with a lubricating oil supply passage 15 which is formed in parallel with the bolt holes 8 for supplying lubricating oil to the engine valve unit.

As shown in FIG. 2, the bottom end 16 of the water jacket 4 extends deeper than those of conventional water jackets to bring it as close to the crank case 11 as possible; in the present embodiment, the width (A) of the bottom end 16 of the water jacket 4 is 6 mm while the thickness (B) of the cylinder block wall (B) between the bottom end 16 of the water jacket 4 and the inner surface of the crank case 11 is also 6 mm. Thus, by selecting the dimensions A and B so that the relationship $B/A <= 1$ holds, the capability of the cylinder block 1 to cool the interior of the crank case 11 is enhanced and, through effective heat transfer of the lubricating oil, whether it may be adhering to the inner surface of the skirt 12 or suspended in the interior of the crank case 11 as an oil mist, the lubricating oil is favorably cooled.

The bottom end 16 of the water jacket 4 which is constructed as described above is provided with semi-cylindrical projections 17 projecting toward the open end of the water jacket 4, at its parts located between adjacent cylinders. In this particular embodiment, each of the projections 17 is substantially semi-cylindrical in shape having a flat bottom end directed to the crank case 11 and a longitudinal line extending perpendicularly to both the longitudinal lines of the cylinders and a longitudinal line along which the cylinders are arranged. These projections 17 define those parts of the bottom wall which have a greater thickness and space the bottom end 16 of the water jacket 4 away from the interior of the crank case 11, but these regions are not very effective for cooling the crank case 11 since they are located right above the journal bulkheads provided in the crank case not shown in the drawings and the projections 17 do not substantially affect the cooling of the crank case 11. For the positional relationship between the journal bulkheads and the cylinders, reference is made to U.S. Pat. No. 4,394,850 and Japanese Patent Laid-Open Publication No. 57-149613.

The core for forming the water jacket 4 is required to be pulled out from the water jacket 4 after the cylinder block 1 has been cast and hooks for pulling out the core from the cast cylinder block are desired to be provided in those parts of the core where the mechanical strength is greatest. Therefore, two pairs of hooks 18 are provided, two on either side of the part between the first cylinder bore 6 and the second cylinder bore 6 and the other two on either side of the part between the third cylinder bore 6 and the fourth cylinder bore 6 as shown in FIG. 1 by imaginary lines. These hooks 18, in combination with the provision of the projections 17 provided in the bottom end of the water jacket 4, are highly effective for facilitating the pulling of the core out of the water jacket 4.

In the present embodiment, the radial thickness (C=3 mm) of the cylinder sleeves 5 is substantially equal to the radial thickness (D=b 3 mm) of the cylinder block inner wall 3 surrounding the outer periphery of the cylinder sleeves 5. Since these thicknesses are substantially equal to each other (C=D), the tendency of the thermal deformation of these parts are substantially equalized and the distortion of the cylinder sleeves 5 is substantially eliminated with the result that the clearance between the pistons and the inner surfaces of the cylinder bores is properly controlled and the consumption of oil due to combustion thereof is accordingly reduced. Furthermore, the thickness (E) of the cylinder block inner wall 3 between adjacent cylinders, along the direction of the cylinder row, is made substantially identical to the thickness of the other part of the cylinder block inner wall 3 (E=D) and the above mentioned effect is even more enhanced.

According to the present invention, the depth (F) of the water jacket 4 can be increased without substantially increasing the width of the water jacket 4. In particular, the ratio of the depth (F) of the water jacket 4 to the width (G) of the water jacket 4 at its open end is made 15 or greater (F/G>=15) and a high cooling efficiency was obtained without unduly increasing the volume of the water jacket 4. In this particular embodiment, the width (G) of the water jacket at its open end was 6.5 mm while the length or the depth (F) of the water jacket 4 was 130 mm.

In the water jacket according to the present invention, the bottom end 16 extends deeper than conventional water jackets towards the crank case 11, but since the water jacket 4 is narrower than conventional water jackets as being substantially equal to the sum of the thicknesses of the cylinder block outer wall 2 and the cylinder block inner wall 3 the overall capacity of cooling water is not substantially increased with the result that the performance of the passenger compartment heater using the cooling water is not impaired.

Thus, according to the present invention, since the release of the cores from the cast cylinder block is facilitated by the provision of the projections in the bottom end of the water jacket, the depth of the water jacket can be increased and the bottom end of the water jacket can be brought close to the crank case. As a result, the lubricating oil in the crank case is favorably cooled.

Furthermore, since the projections are provided in the regions between adjacent cylinders which are located right above the journal bulkheads, the projections themselves do not cause any substantial reduction in cooling efficiency. Additionally, the projections improve the flow of molten casting material. When hooks for pulling the core from the water jacket are provided in those parts of the core located right above the projections, it, in combination with the effect of the projections in reducing the susceptibility of the core to the notch effect, facilitates the release of the core from the water jacket in a most effective way.

Although the present invention has been shown and described with reference to the preferred embodiment thereof, it should not be considered as limited thereby. Various possible modifications and alterations could be conceived of by one skilled in the art to any particular detail, without departing from the spirit of the present invention. For instance, the present invention is particularly advantageous when the cylinder block is made of die cast aluminum alloy but can be applied to other cylinder blocks which are made of different materials or made by different casting processes.

What we claim is:

1. A cylinder block for a water-cooled multi-cylinder internal combustion engine, comprising:

a cylinder block inner wall defining an outer surface of a plurality of cylinders;

a cylinder block outer wall;

means for joining lower portions of said inner wall and said outer wall, said inner wall, said outer wall and said joining means comprising a means for defining a water jacket; and a skirt extending from a part of the cylinder block outer wall at said joining means, said skirt at least partially defining a crank case, wherein said joining means comprises the bottom end of said water jacket, a part of said bottom end includes a projection which projects towards an open end of the water jacket and extends from said inner wall to said outer wall, said projection having a decreasing cross-sectional area as it projects towards said open end.

2. A cylinder block for a water-cooled multi-cylinder internal combustion engine as defined in claim 1, wherein the projection is provided in a part of the bottom end of the water jacket intermediate between adjacent cylinders.

3. A cylinder block for a water-cooled multi-cylinder internal combustion engine as defined in claim 1, wherein the projection is provided in a part of the bottom end of the water jacket corresponding to a bearing bulkhead provided in the crank case.

4. A cylinder block for a water-cooled multi-cylinder internal combustion engine as defined in claim 1, wherein the thickness of the cylinder block between the bottom end B of the water jacket and the crank case with the exception of the part where the projection is provided is no greater than the width of the water jacket A at its bottom end.

5. A cylinder block for a water-cooled multi-cylinder internal combustion engine as defined in claim 1, wherein the ratio of the depth of the water jacket F to the width G of the water jacket at an open end thereof is no less than 15.

6. A cylinder block for a water-cooled multi-cylinder internal combustion engine as defined in claim 1, wherein the cylinder block is made by die casting.

7. A cylinder block for a water-cooled multi-cylinder internal combustion engine as defined in claim 1, wherein a thickness of said joining means, with the exception of said projection, is substantially equal to a width of the water jacket at its bottom end.

8. A cylinder block for a water-cooled multi-cylinder internal combustion engine comprising:

a cylinder block inner wall defining an outer surface of a plurality of cylinders;

a cylinder block outer wall;

means for joining lower portions of said inner wall and outer wall, said inner wall, said outer wall and said joining means comprising a means for defining a water jacket; and a skirt extending from a part of the cylinder block outer wall at said joining means, said skirt at least partially defining a crank case, wherein said joining means comprises the bottom end of said water jacket, a part of said bottom end includes a projection which projects towards an open end of said water jacket and extends from said inner wall to said outer wall, wherein the projection is substantially semi-circular cross-section when taken along a direction in which said cylinders are arranged.

9. A cylinder block for a water-cooled multi-cylinder internal combustion engine, comprising:

a cylinder block inner wall defining an outer surface of a plurality of cylinders, said inner wall including a portion completely filling a gap between adjacent cylinders;

a cylinder block outer wall;

means for joining said inner wall and said outer wall, said joining means and said inner and outer walls comprising a means for defining a water jacket; and a skirt extending from a part of the cylinder block outer wall at said joining means, said skirt at least partially defining a crank case, wherein a part of the bottom end of the water jacket intermediate between adjacent cylinders is provided with a projection extending towards an upper end of the water jacket, said projection extending between said inner wall and said outer wall.

10. A cylinder block for a water-cooled multi-cylinder internal combustion engine as defined in claim 9, wherein said projection is substantially semi-cylindrical in shape having a flat bottom end directed to the crank case with its longitudinal line extending perpendicularly to both a longitudinal line of the cylinders and a direction along which the cylinders are arranged.

11. A cylinder block for a water-cooled multi-cylinder internal combustion engine as defined in claim 9, wherein the projection is provided in a part of the bottom end of the water jacket corresponding to a bearing bulkhead provided in the crank case.

12. A cylinder block for a water-cooled multi-cylinder internal combustion engine as defined in claim 9, wherein the thickness of the cylinder block between the bottom end of the water jacket and the crank case, with the exception of the part where the projection is provided, is no greater than the width of the water jacket at its bottom end.

13. A cylinder block for a water-cooled multi-cylinder internal combustion engine as defined in claim 9, wherein a thickness of said joining means, with the exception of said projection, is substantially equal to a width of the water jacket at its bottom end.

14. A cylinder block for a water-cooled multi-cylinder internal combustion engine as defined in claim 9, wherein the ratio of the depth of the water jacket to the width of the water jacket at an open end thereof is no less than 15.

15. A cylinder block for a water-cooled multi-cylinder internal combustion engine as defined in claim 9, wherein the cylinder block is made by die casting.

* * * * *